United States Patent [19]

Oelsch et al.

[11] Patent Number: 4,902,862

[45] Date of Patent: Feb. 20, 1990

[54] KEYBOARD SWITCH DEVICE FOR FACILITATING REMOVAL AND REPLACEMENT OF PUSH BUTTONS

[75] Inventors: Jurgen Oelsch, Hohenroth; Bertold Sturmer, Bad Kissingen; Nicola Digiovinazzo, Hohenroth; Gerhard Hochgesang, Bad Neustadt/Saale-Lebenhan, all of Fed. Rep. of Germany

[73] Assignee: Preh Elektrofeinmechanische Werke Jakob Preh Nachf GmbH & Co., Bad Neustadt/Saale, Fed. Rep. of Germany

[21] Appl. No.: 193,107

[22] Filed: May 12, 1988

[30] Foreign Application Priority Data

Jun. 13, 1987 [DE] Fed. Rep. of Germany ..... 3719839

[51] Int. Cl.[4] ..... H01H 3/12

[52] U.S. Cl. ..... 200/344

[58] Field of Search ..... 200/340, 344, 345; 400/295, 296, 290

[56] References Cited

U.S. PATENT DOCUMENTS

| | | | |
|---|---|---|---|
| 4,433,225 | 2/1984 | Cowles | 200/340 |
| 4,468,145 | 8/1984 | Denley | 400/496 |
| 4,580,022 | 4/1986 | Oelsch et al. | 200/340 |
| 4,771,146 | 9/1988 | Suzuki et al. | 200/340 |

FOREIGN PATENT DOCUMENTS

| | | | |
|---|---|---|---|
| 178452 | 10/1985 | European Pat. Off. | 200/340 |

*Primary Examiner*—Renee S. Luebke

*Attorney, Agent, or Firm*—Woodcock Washburn Kurtz Mackiewicz & Norris

[57] ABSTRACT

Push button device having a parallel guide member between a button head and a guide. A catch device holds the parallel guide member in a lock-in position so that the button head supporting the parallel guide member can be fitted easily to the guide. In the lock-in position, stop members of the parallel guide member are located in front of engraving slots. By pressing the button head, the parallel guide member is moved from the log-in position into the operating position. The stop members move into the engaging slots.

3 Claims, 4 Drawing Sheets

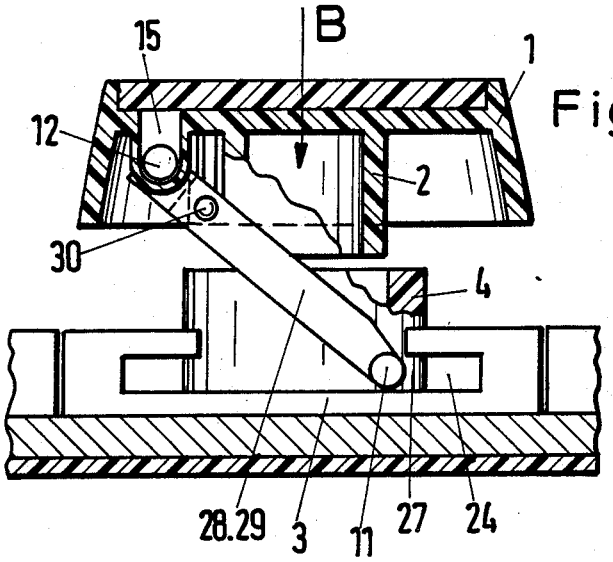
Fig.5
Fig.6
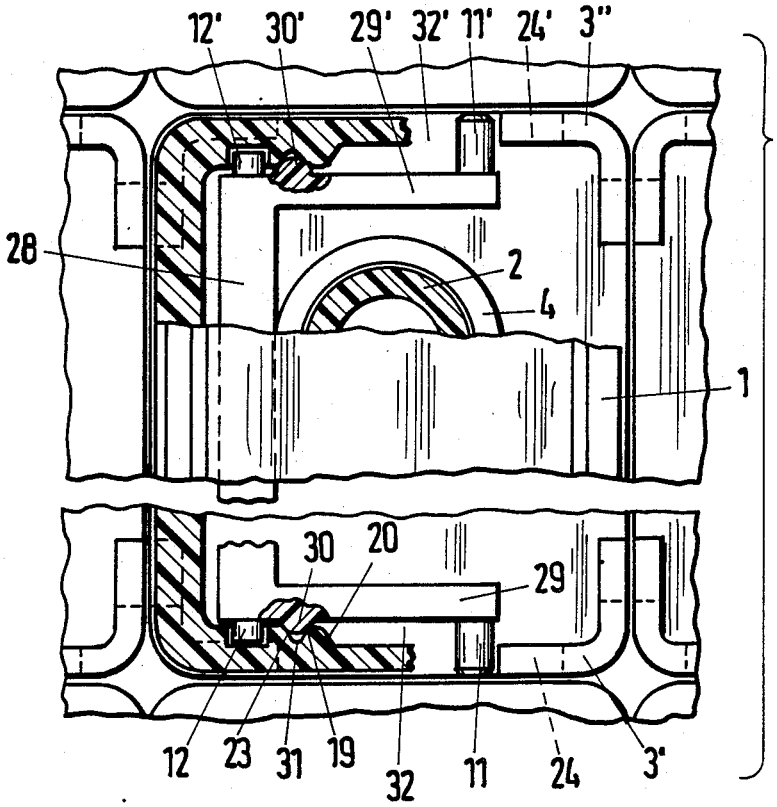

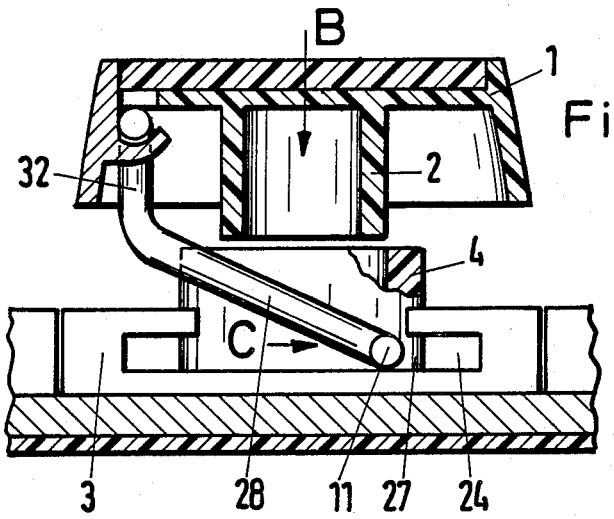
Fig.7
Fig.8
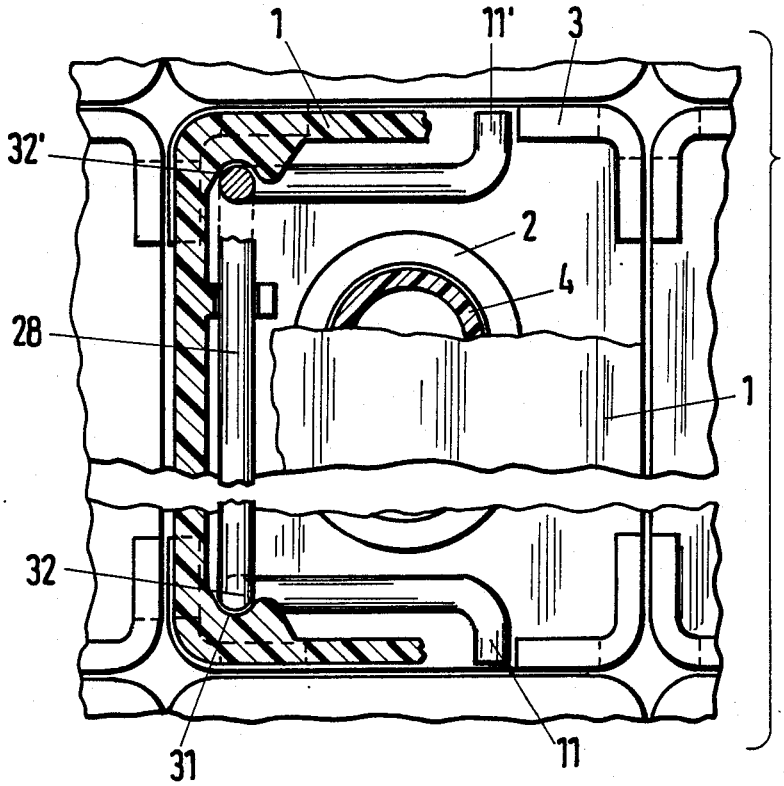

KEYBOARD SWITCH DEVICE FOR FACILITATING REMOVAL AND REPLACEMENT OF PUSH BUTTONS

BACKGROUND OF THE INVENTION

1. Field of the Invention

This invention relates to a push button device having a button head which can be pressed to bring an electrical switch contact out of an operating position and into a switching position and a guide associated with the button head on an arrangement bearing the switch contact. More specifically, this invention relates to a push button device where a parallel guide member such as scissors or a stirrup is arranged between the button head and the guide where in both the operating position and the switching position, the parallel guide member engages engagement slots in the guide with its first stop member and engages slots formed as part of the button head with its second stop member.

2. Description of the Prior Art

A push button device is described in Oelsch U.S. Pat. No. 4,580,022. In this patent, parallel guide members are formed from a double scissors to achieve a secure parallel guiding of the button head in relation to the guide even when comparatively large button heads are utilized. Parallel guiding of this type insures that the desired switching operation is carried out without a tilting or jamming of the button head independent of the point at which the button head is pressed.

Push button devices are also known in which a stirrup is provided as the parallel guide member. Typically, such parallel guide members use a very long button head. In the case of the known push button devices which utilize a stirrup as the parallel guide member, complications in fitting the button bearing the parallel guide member to the guide are well known. Such complications are typically due to the fact that the movable parallel guide member must be introduced from the edge into the engaging slots of the guide while, at the same time, the button head must be held in an aligned position.

SUMMARY OF THE INVENTION

The object of this invention is to propose a push button device for which the button head with the parallel guide member can be fitted to and removed from the guide without damaging neighboring devices.

The above object is achieved by the present invention of a push button device where a catch device is formed at the button head for holding the parallel guide member in a locked-in position. In the locked-in position with the button head set out on the guide, the first stop member of the parallel guide members is positioned in front of openings of engaging slots of the guide. By pressing the button head onto the guide, the parallel guide member moves out of the locked-in position and into the operating position, whereby the first stop area of the parallel guide members moves into the engaging slots.

The parallel guide members supported by the button head are brought into the locked-in position for assembly. The button head, aligned from above in its operating direction, is placed on the guide while the first stop member of the parallel guide member of itself is located in front of openings of the engaging slots of the guide. If the button head is then pressed, the locked-in position is released and the first stop member of the parallel guide member moves into the engaging slots. No manipulation of the parallel guide member is required when fitting the button head at the guide and therefore, no special fitting devices are required. As the fitting of the button head in the operating direction is affected from above, the button head can also be fitted if other fitted button heads are in the area surrounding it.

It is also advantageous that, if necessary, the button head with the parallel guide member ca be withdrawn upwards to subsequently alter the position of the button head in relation to the guide, e.g. by displacing or twisting it. This is an advantage as one of several adjacent switching contacts provided in the guide or located in the grid can be operated with the button head as required.

BRIEF DESCRIPTION OF THE DRAWINGS

The present invention will be better understood and its numerous objects and advantages will become apparent to those skilled in the art by reference to the accompanying drawings in which:

FIG. 5 is a sectional view of a next embodiment of the push button device with a stirrup;

FIG. 6 is a sectional top view of the push button device of FIG. 5;

FIG. 7 is a second embodiment of a push button device with a stirrup; and

FIG. 8 is a sectional top view of the push button device according to FIG. 7.

DESCRIPTION OF THE PREFERRED EMBODIMENT

Figure 1:
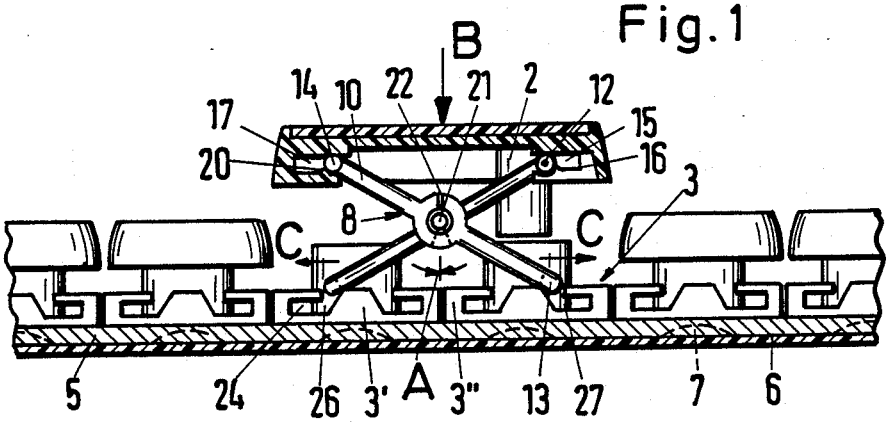
FIG. 1 is a sectional view of the push button device of the present invention in the locked-in position.

Turning first to FIG. 1, a push button device having a button head 1 is shown. Cylindrical plunger 2 is formed on button head 1. Guide 3, which is formed from symmetrically shaped guide parts 3' and 3" is associated with button head 1. Guide sleeve 4 is formed at guide 3 for guiding button plunger 2. Guide 3 is secured to plate 5. Switching foil 6 is arranged on plate 5 and includes switching dome 7 located in the base of guide sleeve 4.

Figure 2:
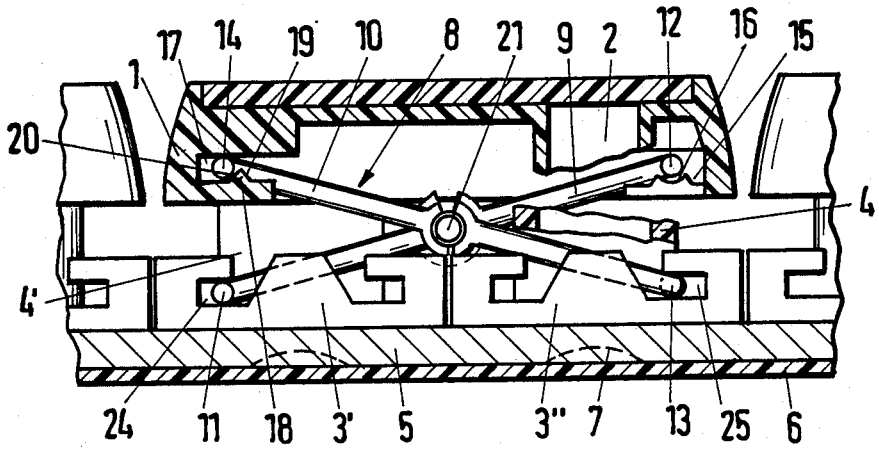
FIG. 2 is a sectional view of the push button device of FIG. 1 in the operating position.

Turning next to FIG. 2, the elements of the push button device of FIG. 1 may be seen in greater detail. Scissors 8, which includes a first arm 9 and a second arm 10, is disposed between button head 1 and guide 3. Scissors 8 acts as a parallel guide member for the push button device. Pins 11, 12, 13 and 14 are provided at each end of arms 9 and 10, respectively. Button head 1 is formed to provide slot 15 in which a bearing dish 16 for pin 12 is provided. Pin 12 is rotatable in slot 15 but is mounted on bearing dish 16 such that it is non-displaceable within slot 15. Button head 1 is formed to also provide slot 17 for receiving pin 14 of arm 10. The location into which pins 12 and 14 are disposed defines a second stop for parallel guide member 8. Pins 12 and 14 act as second stop members when engaged with bearing dish 16 and stop face 19 respectively.

Stop cam 18, which acts as a catch device for pin 14 in a manner to be more fully described later, includes a stop face 19 and a stop face 20 and is formed along slot 17. As may be seen in FIG. 1, stop 22 is formed in the area of moving joint 21 of scissors 8 to prevent arms 9 and 10 being moved further towards each other in the direction of arrows "A". Engaging slots 24 and 25 are provided with openings 26 and 27 on one side are formed on guide 3 for receiving pins 11 and 13 respectively.

Figure 3:
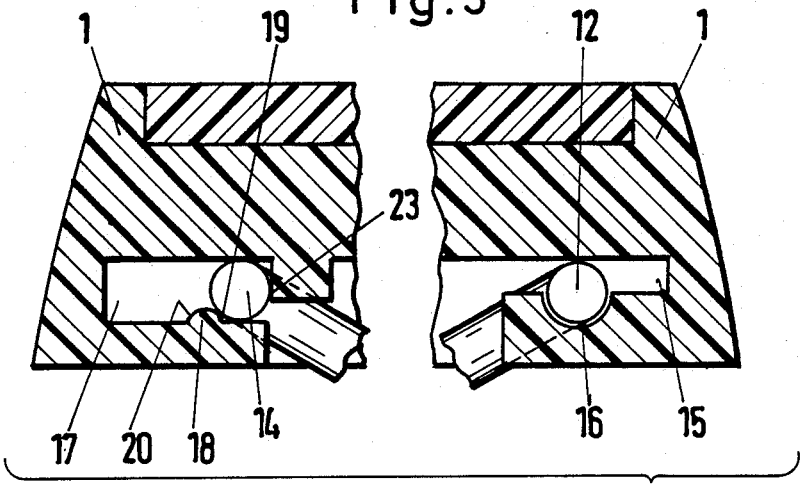
FIG. 3 is a sectional view of a second embodiment of the construction of the button head of FIG. 1.

Turning next to FIG. 3, a second embodiment of the construction of button head 1 may be seen. Again, button head 1 is formed to also provide slot 17 for receiving pin 14 of arm 10 and stop cam 18, which includes a stop face 19 and a stop face 20, is formed along slot 17. In this embodiment, however, push button head 1 is formed to provide a further stop face 23 for slot 17. It is contemplated by the inventors that stop face 23 may be utilized in place of stop 22 shown in FIG. 1.

Figure 4:
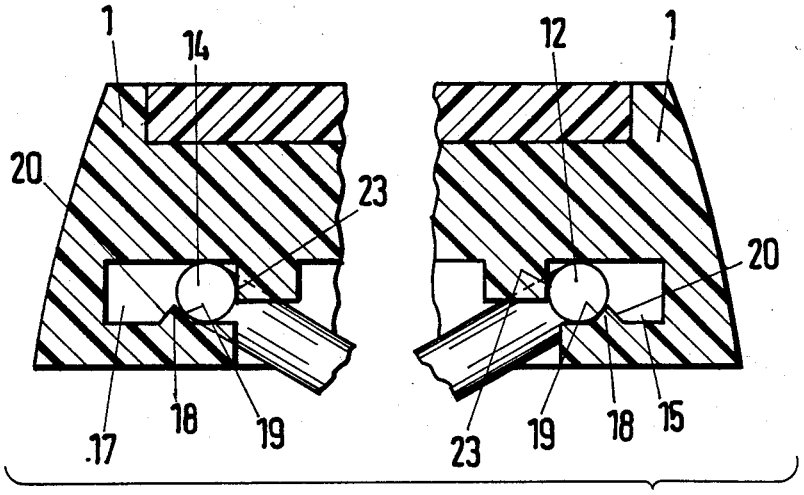
FIG. 4 is a sectional view of yet another alternate embodiment of the construction of the button head of FIG. 1.

Turning next to FIG. 4, a third embodiment of the construction of button head 1 may be seen. Here, a stop cam 18, which includes stop faces 19 and 20, is provided for both slots 15 and 17. Slot 15 is further provided with a stop face 23 in place of bearing dish 16 of the embodiment shown in FIG. 3. As shown in FIG. 4, slots 15 and 17 are of corresponding construction for this embodiment.

The method of operation of the device described herein is as follows:

Before fitting button head 1 to guide 3, scissors 8 are brought into a lock-in position at button head 1. Thus, arm 10 and consequently arm 9 are blocked in the lock-in position. When the button head is configured according to the embodiment of FIGS. 1 and 2, the lock-in position is achieved when pin 14 abuts at stop face 19 of stop cam 18 and arms 9 and 10 lie against each other at stop 22 as shown in FIG. 1. Alternately, when the button head is configured according to the embodiment of FIG. 3, the lock-in position is achieved when pin 14 is held between stop face 19 and stop face 23. When the button head is configured according to the embodiment of FIG. 4, the lock-in position is achieved when pin 12 is also held in slot 15 between stop face 19 and stop face 23.

With the scissors 8 in the lock-in position, button head 1 is placed and aligned on guide 3. Button plunger 2 will thus engage in the corresponding guide sleeve 4. Pin 11 is located at the opening 26 of engaging slot 24 and extends upwardly on the base of engaging slot 24. Pin 13 is located at the opening 27 of engaging slot 25 and extends upwardly on the base of engaging slot 25. The location of pins 11 and 13 define a first stop member for parallel guide member 8.

Button head 1 is then pressed in the direction of arrow "B" as shown in FIG. 1 to snap pin 14 over stop face 19 of stop cam 18 and into slot 17. If the button head configuration as shown in FIG. 4 is utilized, movement in the direction of arrow "B" will also cause pin 12 to snap into position over stop face 19 of stop cam 18 into slot 15. The first stop member of parallel guide member 8, i.e. pins 11 and 13, will move into engaging slots 24 and 25. The button head 1 is now in its operating position as shown in FIG. 2. Button head 1 can be brought out of the operating position into and the switching position by again pressing in the direction of arrow "B". In the switching position, button plunger 2 presses down switching dome 7 in such a way that electrical contacts (not shown) arranged in switching dome 7 are closed. With the movement of button head 1 between the operating position and switching position, pins 11 and 13 are moved into engaging slots 24 and 25 respectively in the direction of arrows "C" Pin 14 is displaced in the corresponding manner in slot 17. Again, if the button head configuration according to FIG. 4 is utilized, pin 12 is displaced in the corresponding manner in location 15 as well.

Button head 1 is returned to the operating position from the switching position by means of the spring action of switching dome 7. The return to the operating position is restricted, however, by pin 14 coming into contact with stop face 20 of stop cam 18.

To remove button head 1, button head 1 is raised in the opposite direction to arrow "B" of FIG. 1. Pin 14 will be displaced in slot 17 until pin 14 locks against stop face 20, thus bringing button head 1 into the position shown in FIG. 1. In this position, pins 1 and 13 are located in openings 26 and 27 so that button head 1 along with scissors 8 can be removed from the guide 3. At the same time, the scissors 8 can be brought into the lock-in position.

Button head 1 and scissors 8 can then be turned against guide 3 in such a way that switching plunger 2 may be engaged in guide sleeve 4' of guide part 3'. In such a manner, button head 1 may be associated with another switching dome.

Turning next to FIG. 5, an alternate embodiment of the present invention where the parallel guide member is formed from a stirrup 28 is now described. As shown in FIG. 5 and 6, push button 1 is provided with stirrup 28 having pins 12, 12' rotatably mounted in location 15 of button head 1. The location of pins 12, 12' define the second stop member for stirrup 28.

As shown in FIG. 6, protuberances 30 and 30' are formed on sides 29 and 29' of stirrup 28 respectively. Button head 1 is provided with cavities 31 and 31' for association with protuberances 30 and 30' respectively. Similar to stop cam 18 of the embodiment of FIGS. 1–4, cavity 31 acts as a catch device for protuberance 30. Cavity 31 forms stop faces 19, 20 and 23 for protuberance 30. In a corresponding fashion, cavity 31' forms stop faces 19, 20 and 23 for protuberance 30'. Sides 29 and 29' are also provided with pins 11 and 11' for engaging slots 24 and 24' of guide 3.

In the lock-in position, protuberances 30 and 30' engage cavities 31 and 31', respectively. If button head 1 is placed on guide 3, pins 11 and 11' located in front of engaging slots 24 and 24' in the lock-in position of stirrup 28. The location of pins 11 and 11, define the first stop member for stirrup 28.

When the button head 1 is pressed, protuberances 30 and 30' are released from cavities 31 and 31', respectively. Pin 11 moves into engaging slot 24 while pin 11' moves into engaging slot 24'. Button head 1 can then be moved between its operating and its switching position while protuberances 30 and 30' can be displaced freely in free space 32 and 32'. In the lock-in position, protuberance 30 is located between stop faces 19 and 23. When button head 1 is moved out of the switching position, protuberance 30 comes into contact with stop face 20 and protuberance 30' comes into contact with its corresponding stop face 20 as well.

As shown in FIGS. 7 and 8, stirrup 28 consists of a wire stirrup with its ends forming the pins 11 and 11'. Stirrup 28 is provided with side sections 32 and 32' with which groove-shaped cavities 31 and 31' of button head 1 are associated. In the lock-in position, the side sections 32 and 32′ engage in the cavities 31 and 31′ to form the above mentioned stop faces. The method of operation is as described above.

Thus, there has been described and illustrated herein a push button device having a button head which can be pressed to bring an electrical switch contact out of an operating position and into a switching position. However, those skilled in the art will recognize that many modifications and variations besides those specifically set forth may be made in the techniques described herein without departing substantially from the concept of the present invention. Accordingly, it should be clearly understood that the form of the invention described herein is exemplary only, and is not intended as a limitation on the scope of the claims.

What is claimed is:

1. A push button device comprising: a button head having slots; an electrical switch contact means for connecting and disconnecting an electrical signal, said switch contact means having an operating position and a switching position; a guide having engagement slots, the guide bearing the switch contact means, the button head capable of being pressed to bring the switch contact means out of the operating position and into the switching position; and a parallel guide member having a first and second stop member, the parallel guide member arranged between the button head and the guide, wherein in the operating position and the switching position, the first stop member of the parallel guide member engages the engagement slots of the guide and the second stop member of the parallel guide member engages the slots in the button head, characterized in that the push button device further comprises:

a catch device for holding the parallel guide member in a lock-in position, wherein in the lock-in position with the button head located on the guide, the first stop member of the parallel guide member is located in front of openings of the engagement slots and that by pressing the button head onto the guide, the parallel guide member is moved out of the lock-in position into the operating position, whereby the first stop member moves into the engagement slots, the catch device further comprising a further stop face for preventing the parallel guide member from being moved from the operating position into the lock-in position when the button is operated; and a stop cam having a first stop face and a second stop face is formed at one of the slots of the button head.

2. A push button device comprising a button head having slots, an electrical switch contact means for connecting and disconnecting a switch having an operating position and a switching position, a guide having engagement slots, the guide bearing the switch contact means, the button head capable of being pressed to bring the switch out of the operating position and into the switching position, and a parallel guide member having a first and second stop member, the parallel guide member arranged between the button head and the guide, wherein in the operating position and the switching position, the first stop member of the parallel guide member engages the engagement slots of the guide and the second stop member of the parallel guide member engages the slots in the button head, characterized in that the push button device further comprises:

a catch device for holding the parallel guide member in a lock-in position, wherein in the lock-in position with the button head located on the guide, the first stop member of the parallel guide member is located in front of openings of the engagement slots and that by pressing the button head onto the guide, the parallel guide member is moved out of the lock-in position into the operating position, whereby the first stop member moves into the engagement slots, the parallel guide member further comprises a stirrup and wherein at least one side of the button head has a cavity therein, wherein the catch device is formed by the cavity on the side of the button head.

3. Push button device according to claim 2, wherein the stirrup comprises a protuberance, the protuberance cooperating with the cavity provided at the side of the button head.

* * * * *

UNITED STATES PATENT AND TRADEMARK OFFICE

CERTIFICATE OF CORRECTION

PATENT NO. : 4,902,862

DATED : February 20, 1990

INVENTOR(S) : Oelsch et al.

It is certified that error appears in the above-identified patent and that said Letters Patent is hereby corrected as shown below:

In the Abstract, line 7, the word "engraving" should be --engaging--.

Col. 4, line 18, "pins 1 and 13" should read --pins 11 and 13--.

Signed and Sealed this

Ninth Day of November, 1993

*Attest:*

*Attesting Officer*

Bruce Lehman

BRUCE LEHMAN

*Commissioner of Patents and Trademarks*